United States Patent [19]

Cestrieres et al.

[11] 3,946,851

[45] Mar. 30, 1976

[54] ELECTROMAGNETIC ASSEMBLY FOR ACTUATING A STYLUS IN A WIRE PRINTER

[75] Inventors: Jacques Cestrieres, Paris; Christian Condon, St. Ouen; Bernard Mouton, Creteil, all of France

[73] Assignee: Burroughs Corporation, Detroit, Mich.

[22] Filed: Oct. 11, 1974

[21] Appl. No.: 514,056

Related U.S. Application Data

[63] Continuation of Ser. No. 330,659, Feb. 8, 1973, abandoned.

[30] Foreign Application Priority Data

Feb. 18, 1972 France ..... 72.05558

[52] U.S. Cl. ..... 197/1 R; 335/229; 335/234; 335/256

[51] Int. Cl.[2] ..... B41J 1/18

[58] Field of Search ..... 335/229, 234, 236, 254, 335/256, 266, 268, 255, 258, 274, 232; 197/1 R

[56] References Cited

UNITED STATES PATENTS

| | | | |
|---|---|---|---|
| 3,070,730 | 12/1962 | Gray et al. | 335/229 |
| 3,119,940 | 1/1964 | Pettit et al. | 335/229 X |
| 3,543,906 | 12/1970 | Hladky | 335/256 X |
| 3,729,079 | 4/1973 | Zenner et al. | 197/1 R |
| 3,755,766 | 8/1973 | Read | 335/229 |
| 3,775,714 | 11/1973 | Heuer | 335/234 X |

*Primary Examiner*—Edgar S. Burr
*Assistant Examiner*—R. T. Rader
*Attorney, Agent, or Firm*—Richard Jordan; Franklin D. Ubell; Leonard C. Suchyta

[57] ABSTRACT

An electromagnetic circuit for controlling the travel of a stylus by attaching the stylus to a movable core. The movable core cooperates with a drive coil to form a magnetic circuit with annular portions extending into the drive coil from both ends thereof.

10 Claims, 5 Drawing Figures

LEGEND

MAGNETIC FLUX PRODUCED BY:

39 ∞∞∞∞ 45 —·—·— 30 — — —

ELECTROMAGNETIC ASSEMBLY FOR ACTUATING A STYLUS IN A WIRE PRINTER

This is a continuation of application Ser. No. 330,659, filed Feb. 8, 1973, now abandoned.

SUMMARY OF THE INVENTION

The invention relates to wire printers, used as output devices for electronic calculators or for computers.

In such printers, the individual signs are formed by a certain number of printed points. Each point is obtained on a medium, for example, paper, by means of a wire or stylus which is actuated by an electromagnet which strikes an inked ribbon and causes a printed point on the medium.

Although the word "wire" is a term of art for a writing element thus actuated, in the following description and in the claims the term "stylus" will be used which corresponds better to the function of a writing element. The term "wire printer", however, will not be modified.

More particularly, this invention concerns a driving-electromagnetic set of the wire printer type. Such a printer includes in general a plurality of actuating elements, suitably arranged to allow simultaneous printing according to a predetermined distribution of dots.

The electromagnetic actuating means for styli of known type include one or several control coils used for the printing movement. They include in general release springs for the return of the stylus.

The control means of styli are subject to two technical requirements which are in fact contradictory: (1) on one hand, the mass of the movable part must be reduced as much as possible, and the consumption of electric energy needed for the actuation must also be reduced as much as possible. (2) on the other hand, to obtain a correct printing, it is necessary for the movable means to have a determined speed at the time of the stylus impact. This speed increases with the increase in the number of ampere turns of the coil, with the increase in mass of the movable part. The foregoing is based on the movable part having a predetermined course.

To have the magnetic flux produced by the coil suitably arranged relative to the movable core, it is necessary that its size and consequently its mass be in relation to the size and the mass of the coil.

Further, it is necessary to increase as much as possible the output of the movable electromagnetic core means to obtain the smallest values possible for both the consumption in electric energy and for the mass of the movable part.

Moreover, the use of return springs results in a pull-back strength which is maximized when the spring is stretched out as much as possible; i.e. at the point of printing the electric energy provided in the actuation coil is used partially to overcome this pull-back force which increases the electric consumption of the device.

On the other hand, the pull-back strength of the spring is minimized when the core is in the pullback position which results in producing considerable rebound.

Further the pull-back systems of the prior art and, more specifically, of the return spring systems work only for frequencies which depend on the mechanical linkage between the stylus and the movable core on the one hand, and the electromagnetic actuation means on the other hand. These frequencies comprise very low frequencies with a higher nominal frequency being possible by the actuation of a stylus which is in phase with the rebound of a different stylus. Accordingly, devices of this type can not work at high variable frequencies.

One of the main objects of the present invention is to provide electromagnetic means of actuation for a wire printer in which the rate of output is higher than in the devices of the prior art.

Another purpose of this invention is to provide electromagnetic means with little or no rebound.

Another purpose of the invention is to provide such electromagnetic means in which the return of the movable part is realized in such a manner that the pull-back force is zero at the time of the print.

Another object of the present invention is to provide an electromagnetic actuation means for wire printers with no resonance effect at a high nominal frequency.

The electromagnetic means according to the invention is characterized in that inside the driving coil the magnetic circuit includes a fixed core and an annular part placed on both sides of the center of the coil and further characterized in that the movable core attached to the stylus is placed more or less at the center of this coil and partially surrounded with the annular part. The position of the movable core in the middle of the coil allows to the reduction as much as possible, of the leakage flux. The annular part provides a guiding of the movable core.

According to another embodiment of the invention, the electromagnetic driving set includes a second movable core joined to the printing stylus, and a permanent magnet cooperating with a second magnetic circuit to apply to the second movable core a pull-back force, which is consequently transmitted to the printing stylus.

This embodiment provides a pull-back force which is at a maximum in the home position of the printing stylus, and reduces substantially the phenomenon of rebound.

The electromagnetic driving set includes also an auxiliary coil driven at the same time as the driving coil and arranged so as to suppress the pull-back force due to the permanent magnet at the time of the printing command. This auxiliary coil includes a magnetic circuit comprising a permanent magnet arranged like the magnetic circuit associated with the driving coil.

Other characteristics and advantages of this invention will appear in the following description, made with reference to the enclosed drawings, given solely by way of a non-limited example and on which:

Figure 1:
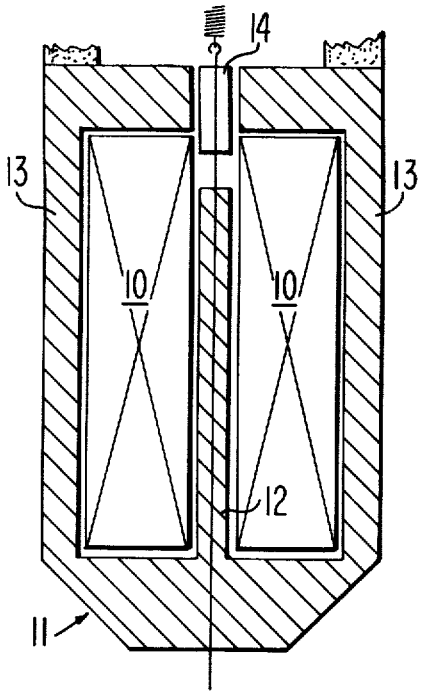
FIG. 1. PRIOR ART.
FIG. 1 is a longitudinal section of an electromagnetic set of the prior art.

FIG. 1 shows a known construction of an electromagnetic set: a coil 10 is associated with a magnetic circuit 11 including a fixed core 12 which goes practically through the whole coil 10, and which is closed by an external part 13 which surrounds a movable core 14 at the free end of the coil 10 which is connected to the printing stylus. When the coil 10 is excited, the fixed core 12 attracts the movable core 14, thus tending to close the electromagnetic circuit as much as possible.

A pull-back spring 09 returns the movable core 14 to its initial position as soon as the exciting of the coil has been removed.

Figure 2:
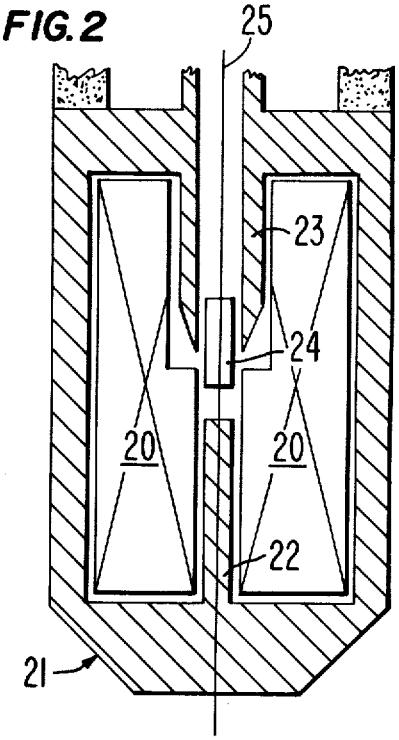
FIG. 2 is a longitudinal schematic section of electomagnetic means for printing styli according to the present invention and shows the arrangement of the magnetic circuit of the driving coil.

In the schematic section of FIG. 2 which shows a device according to this invention, a coil 20 is placed within a magnetic circuit 21 including a fixed axial core 22 which extends inside the coil on one end thereof, and an elongated annular part 23 extending inside the coil but from the other end thereof. The fixed core 22 and the annular part 23 are thus placed on both ends of the center of the coil 20, and spaced a certain distance from said center, so that the magnetic circuit is not closed between these two parts.

A movable core 24 joined to a printing stylus 25 can be moved through the center of the coil, while being at the same time partially positioned inside the annular part thereof. The stylus 25 extends through the axis of the fixed core 22 as well as through the contiguous part of the magnetic circuit on the left part of FIG. 2. The displacement sense of the stylus for printing is on the left of the figure. The position of the movable core 24 in on FIG. 2 is the one during non-printing.

When the core 20 is excited a magnetic flux goes through the magnetic circuit 21, through the annular part 23, the movable core 24 and the fixed core 22.

The annular air gap situated between the movable core 24 and the annular part 23 of the magnetic circuit is crossed by the magnetic flux, which causes radial forces being equal to one another; consequently, the resulting radial forces applied at the level of this annular air gap on the movable core 24 are zero.

On the other hand, the axial air gap situated between the fixed cylindrical core 22 and the movable core 24 is crossed by a magnetic axial flux which results in applying an axial force toward the left of this movable core 24.

It is noted that the arrangement of FIG. 2 diminshes the leakage flux compared with the devices of the prior art and especially the one shown in FIG. 1. If the mass of the movable cores 24 and 14 are the same, the decrease of the leakage flux thus obtained according to the invention gives a better transmission of energy to the printing stylus.

For better results the annular part 23 of FIG. 2 includes a gradual tapering on the end extending into the coil. This arrangement allows to reduce as much as possible the leakage air gap between the annular part 23 and the fixed core 22 thus giving the lines of the magnetic field a preferential path through the movable core 24. Of course, the coil 20 is wound according to a suitable manner around the fixed core 22 and the annular part 23 to provide the maximum flux into these two parts of the magnetic circuit while leaving the movable core free to move.

FIG. 2 shows a preferred embodiment of the invention, according to which the return of the printing stylus to its normal position is obtained by means of a permanent magnet.

Figure 3:
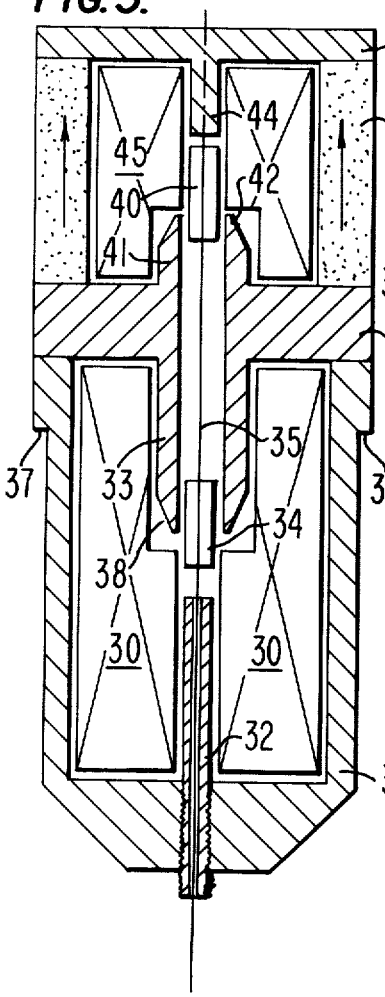
FIG. 3 is a longitudinal section of a preferred embodiment showing the construction of the electromagnetic means according to this invention.

In FIG. 3 an arrangement similar to that in FIG. 2 is shown which includes a coil 30, a magnetic circuit housing 31 surrounding the coil 30, an axial core 32 fixed in a aperture in said housing 31, and going through the coil nearly up to its center. As illustrated in FIG. 3, the core 32 is disposed concentrically about the printing stylus 35.

Of course, the coil includes a central aperture for this purpose.

The magnetic circuit has also as an element thereof an annular part 33 disposed concentrically about the stylus 35 at the inside of the coil 30 in the axial aperture provided for it, and extending nearly up to the center, on the opposite side of the fixed core 32. Outside the coil 30 and on the same side, the magnetic circuit is closed by a radial extension 36 of the annular part 33 having the form of a flange.

A first movable core 34 is arranged on the axis near the center of the coil 30, while being at the same time partially surrounded by the annular part 33 whose diameter has been suitably provided for this purpose. Thus the annular part 33 is used also for guiding the movable core 34.

The said core 34 is joined to the printing stylus 35 which goes through it completely and which extends freely into the axis of the fixed core 32.

A shoulder 37 is used for the mounting of the back part (permanent magnet and return magnetic circuit).

As indicated above, the annular part 33 includes in the direction of the coil center 30 a tapered portion 38 toward the inside.

An annular permanent magnet 39 with an external diameter more or less the same as the external diameter of the flange 36 is arranged coaxially with this flange and in contact therewith on the opposite side of the housing. A second cylindrical; movable core 40 is joined to the stylus 35 and positioned with regard to the first movable core 34 on the side lying opposite the side of the fixed core 32. The spacing between the first and the second movable cores is such that the said second movable core 40 is arranged near the center of the permanent magnet 39.

The annular part 33 extends on the other side of the flange 40 by another magnetic circuit element, elongated annular part 41, which is disposed concentrically about the stylus 35 and reaches nearly up to the center of the permanent magnet 39. This annular part 41 includes in the direction of the said center a portion which is tapered toward the inside 42. The second movable core 40 is partially surrounded by the second annular part 41 which provides a radial air gap or space between the two parts and axial guiding of the second movable core 48.

The second magnetic circuit formed by the second annular part 41, the flange 36 and the permanent magnet 39 is closed by a portion with a radial extension in form of a disc 43 which bears a second fixed, cylindrical magnetic core element 44, extending axially toward the inside to close said second magnetic circuit. The second magnetic circuit is thus arranged with the second movable core 40 as the first magnetic circuit is with the first movable core 34. However, the spacing between the first and the second movable cores is chosen slightly smaller than the spacing between the centers of the coil 30 and the permanent magnet 39 so that when the stylus is (very briefly) in printing position or in home position, only the first movable core 34 or the second movable core 40 respectively is subject to a force of substantial magnetic attraction.

For better results, this design includes an auxiliary coil 45 placed within the second magnetic circuit to cooperate therewith. The auxiliary coil 45 is preferably connected electrically in series with the driving coil 30 and thus arranged in such a manner that when the two coils are excited, the flux produced by the auxiliary coil 45 in the second magnetic circuit cancels the flux due to the permanent magnet 39 so as to cancel the pull-back force due to the latter. It is then advantageous but not necessary that the interior wall for both the annular parts 33 and 41 should be cylindrical with a diameter slightly larger than the external diameter of the two movable cores 34 and 40. It can be noticed that this internal wall of the annular parts and the external wall of each movable core are not necessarily cylindrical. The same applies for the fixed cores.

In connection with the above-mentioned statement about the annular part and the fixed cores: "extending nearly up to the center of the coil or the permanent magnet" it must be understood that, when the associated movable core is attracted by the said core or the said magnet, and is then substantially in the center, the fixed core is so arranged that the movable core substantially engages it, and the annular part is arranged for the radial air gap which has with the movable core in attracted position an axial size sufficient for the magnetic flux produced by the said core or the said magnet to pass.

The parts which make up the electromagnetic means of FIG. 3 are maintained in contact by mounting means, not shown, which rest on one hand, on the shoulder 37 and on the other hand, on the radial and external extension of the end-part 43. This contact is necessary to attain a good closing of the external parts of the magnetic circuits.

Figure 4A:
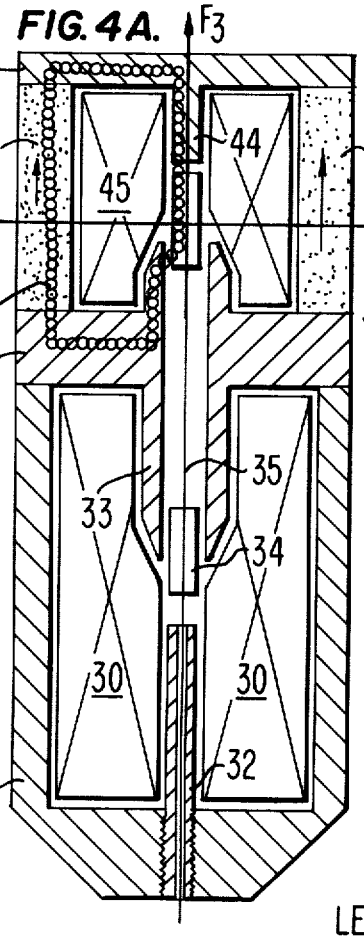
FIGS. 4A and 4B are schematic longitudinal sections of the device of the FIG. 3 showing passage of the magnetic flux when at home position and during the forward printing movement, respectively.
Figure 4B:
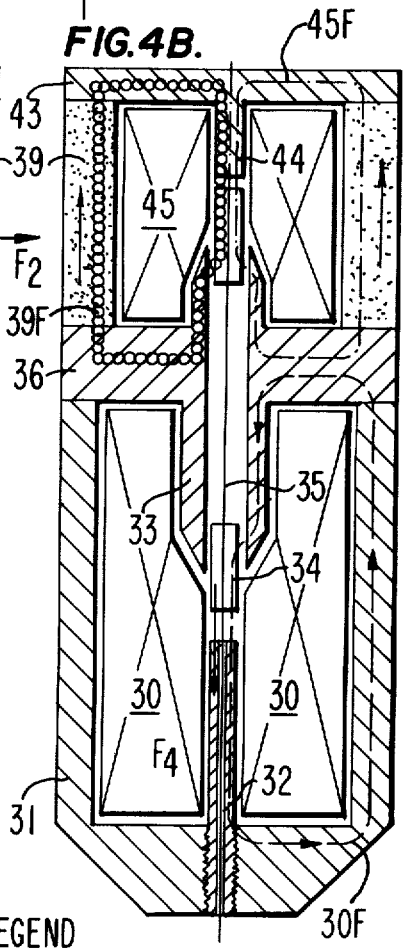

FIGS. 4A and 4B are simplified diagrams of the design of FIG. 3, showing the magnetic flux produced in the normal position of the printing stylus and during the forward movement of the printing stylus, respectively.

In normal position, the magnetic flux (represented by a short dotted line) of the permanent magnet 39 (whose magnetizing direction is represented by an arrow in the axial direction) goes through the said 43 and the second fixed core 44 through the second movable core 40, the second annular part 41 and the flange 36. This results in causing in the radial air gap separating the second movable core 40 from the second annular part 41, radial forces F1 and F2 whose components cancel each other.

On the other hand, the flux going through the axial air gap separating the second movable core 40 and the second fixed core 44 creates an axial force F3 which draws the movable core 40 toward the fixed core 44 and maintains it there. Thus, the movable core 40 is biased in a home position by the action of the permanent magnet 39.

On FIG. 4B the driving coil 30 and the auxiliary coil 45 are excited in series by a current pulse. The direction of this current in the coil 45 is such that the flux produced by this coil (represented by a dash-dot-line) balances notably the flux produced by the permanent magnet 39 (represented by a dotted line). The second movable core 40 is then no longer attracted by the second fixed core 44. Of course, the same applies to the first movable core 34 and to the printing stylus 35.

The same current pulse going through the driving coil 30 creates a magnetic flux (represented by a dashed line) which goes through the first movable core 34. The radial components of the forces is directed to the movable core 34 because this magnetic flux is canceled out. However, the axial components going through the first core 32 create an axial attractive force toward the left of the core 34 and thus against the direction of the biasing force generated by action of the permanent magnet 39 and nullified by excitation of the coil 45. This results in moving the printing stylus 35 and the movable cores 34 and 40 up into contact with the paper or the inking ribbon (not shown) and thus leads to the printing of a point.

When the printing is obtained, the current is switched off. This can be done either because the above-mentioned current printing has a predetermined length or in response to a driving signal of switching off. At this moment, the magnetic flux is once more the one represented in FIG. 4A. The second movable core and thus the whole movable means are attracted on the right because of the attractive force due to the flux created by the magnet 39. Then, the movable means returns to home position.

It must be noted that during the forward movement up to the printing of a point, the first movable core 34 does not necessarily come into contact with the first fixed core 32. The current pulse length and/or the spacing between the movable cores 34 and 40 are thus chosen.

The return movement of the movable means by a permanent magnet creates a maximum return force when the core is in normal position (minimum air gap). The spring return system of the prior art provides a maximum release force when the stylus is at the end of the forward movement and a minimum return force in the home position. The release by means of a permanent magnet diminishes or even obviates the rebounds of the movable means at the time of the impact of the second movable core 40 against the second fixed core 44. Further, to obtain a given impact energy, the necessary electric energy is less important because the force applied to the movable means by the driving coil is not opposed to a release force progressively increasing which is the case with springs. On the contrary, with the auxiliary coil, according to this invention, the pull-back force is canceled at the time of the command of printing whatever the position of the movable means may be.

On the other hand, the reduction of rebounds has two main technical consequences:

— the risk of double printing (one wanted, the second due to the rebound) is reduced for the same course of the movable means. This allows to shorten the course of the stylus;

— and, the fact of not having rebounds and of cancelling the release force for each command of printing allows working with variable frequencies, while in the case of a release force such as the one obtained with springs, and in the case of rebounds, the device can work correctly only on a very low or nominal frequency when each new command of printing is in phase with the rebound.

The magnetic circuits are made of magnetic, soft materials, especially as far as the housing 31, the first fixed core 32, the two annular parts 33 and 41 with their flange 36, the second endpiece 43 with the second fixed core 44, as well as the first and second movable cores 34 and 40 are concerned.

What is claimed is:

1. An electromagnetic assembly for moving a stylus in a wire printer between a retracted home position and an actuated print position comprising:

first magnetic circuit means having as an element thereof a first movable core adapted to be connected to said stylus to move with said stylus between said retracted home position and said actuated print position;

second magnetic circuit means having a second movable core adapted to be connected to said stylus to move with said stylus between said retracted home position and said actuated print position;

permanent magnetic retaining means forming part of said second magnetic circuit means for producing a first magnetic flux biasing said second movable core toward said retracted home position;

first energizable means for inducing in said first magnetic circuit means a second magnetic flux for forcing said first movable core into said actuated print position; and second energizable means for inducing in said second magnetic circuit a third magnetic flux for nullifying said first magnetic flux produced by said permanent magnetic retaining means concurrent with the energization of sais first energizable means.

2. The electromagnetic assembly of claim 1 wherein said permanent magnetic retaining means comprises an annular permanent magnet and wherein said second energizable means comprises a first coil wound within said permanent magnet.

3. The electromagnetic assembly of claim 2 wherein said first energizable means comprises a second coil connected in series with said first coil.

4. An electromagnetic assembly for moving a stylus in a wire printer between a retracted home position and an actuated print position comprising:

first magnetic circuit means including a first elongated annular magnetic circuit element disposed concentrically about said stylus; a first fixed magnetic core element disposed concentrically about said stylus and separated axially from said first annular element; and a first movable magnetic core attached to said stylus and movable with said stylus between said retracted home position and said actuated print position, said first movable core being disposed partially within said first annular element and partially outside said first annular element toward said first fixed core element;

second magnetic circuit means including a second elongated annular magnetic circuit element disposed concentrically about said stylus; a second fixed magnetic core element disposed concentrically about said stylus and separated axially from said first annular element; and a second movable magnetic core attached to said stylus between said retracted home position and said actuated print position, said second movable core being disposed partially within said second annular element and partially outside said second annular element toward said second fixed core element;

permanent magnetic retaining means for producing a first magnetic flux in said second magnetic circuit means for biasing said second movable core in said retracted home position;

first energizable means for inducing a second magnetic flux in said first magnetic circuit means for forcing said first movable core to move into said actuated print position; and second energizable means for inducing in said second magnetic circuit a third magnetic flux for nullifying said first magnetic flux produced by said permanent magnetic retaining means, concurrent with the energization of said first energizable induction means.

5. The electromagnetic assembly of claim 4 wherein said first elongated annular magnetic circuit element has a tapered portion.

6. The electromagnetic assembly of claim 4 wherein said second elongated annular magnetic circuit element has a tapered portion.

7. A magnetic circuit for actuating a stylus comprising:

an energizable coil having a first end and a second end;

an elongaged annular magnetic circuit element located at the first end of said coil and having an end extending axially partially into the interior of said coil;

a cylindrical fixed magnetic core having an end extending axially partially into the interior of said coil from said second end and separated axially from said elongated annular magnetic circuit element, said end of said elongated annular magnetic circuit element and said end of said fixed core being in axial alignment and in close juxtaposition with each other and having an air space therebetween;

magnetic circuit means for connecting a magnetic path between said fixed core and said elongated annular magnetic circuit element; and a cylindrical magnetic core adapted to be attached to said stylus and positioned for limited movement within said air space and said annular magnetic element for completing said magnetic circuit upon energization of said coil.

8. An electromagnetic assembly for actuating a stylus comprising:

a housing comprising an annular magnetic circuit element having an aperture in one end and an open end;

a flange of magnetic material having a first side and a second side, said first side being mounted on said open end, said flange further having an opening adapted to have a stylus passed therethrough;

a first elongated annular magnetic circuit element attached to said flange and extending partially into the interior of said housing;

a first cylindrical stationary magnetic core fixed in the aperture of said housing, protruding into the interior of said housing, spaced apart from said first elongated annular element and adapted to have said stylus passed therethrough;

a first cylindrical movable magnetic core adapted to be attached to said stylus and partially disposed within said first elongated annular element;

a first energizable coil disposed within said housing around said first elongated annular element, said first stationary core and said first movable core;

an annular magnet mounted on the second side of said flange;

a second elongated annular magnetic circuit element attached to the second side of said flange and extending partially into the interior of said annular magnet;

a second cylindrical stationary magnetic core extending into said magnet and spaced apart from said second annular element;

a second cylindrical movable magnetic core adapted to be attached to said stylus and disposed partially within said second elongated annular element;

means for completing a magnetic circuit between said second stationary core and said annular magnet; and a second energizable coil disposed within said annular magnet and around said second elongated annular element, said second movable core and said second fixed core to counteract the magnetic field of said annular magnet upon energization.

9. The electromagnetic assembly of claim 8 wherein said first elongated annular element has a tapered portion.

10. The electromagnetic assembly of claim 8 wherein said second elongated annular element has a tapered portion.

* * * * *